United States Patent [19]

Koenig

[11] Patent Number: 4,938,426

[45] Date of Patent: Jul. 3, 1990

[54] DUAL AUGER SHREDDER

[76] Inventor: Larry E. Koenig, c/o Komar Industries Inc. 4425 Marketing Pl., Groveport, Ohio 43125

[21] Appl. No.: 340,963

[22] Filed: Apr. 19, 1989

Related U.S. Application Data

[63] Continuation-in-part of Ser. No. 187,229, Apr. 28, 1988.

[51] Int. Cl.[5] ..... B02C 18/22; B02C 4/30

[52] U.S. Cl. ..... 241/222; 241/235; 241/260.1; 241/285 A

[58] Field of Search ..... 241/260.1, 261, 224, 241/229, 235, 242, 248, 251, 252, 199.9, 199.12, 222, 285 A, 236; 366/83, 84, 85, 297, 300, 301

[56] References Cited

U.S. PATENT DOCUMENTS

| | | | |
|---|---|---|---|
| 344,472 | 6/1886 | Bauer | 241/222 |
| 2,539,317 | 1/1951 | Nickle et al. | 241/222 |
| 4,253,615 | 3/1981 | Koenig | 241/36 |
| 4,632,317 | 12/1986 | Wexell et al. | 241/30 |

*Primary Examiner*—Joseph M. Gorski

*Attorney, Agent, or Firm*—Thompson, Hine and Flory

[57] ABSTRACT

A dual auger shredder having a grinding chamber within which is mounted a pair of screw augers, each having tapered flights and oriented opposite to each other, and a bottom including a pair of closure doors. The tapered auger screws provide an uneven surface to material fed downwardly from above the grinding chamber and the working edges of the tapered flights are exposed so that the corners and edges of large-surfaced materials such as wood pallets or wooden crates are engaged by the flights and compressed towards the center of the grinding chamber. The bottom closure panels are positioned beneath the screw augers, extend axially relative to them and are akewed so that they follow the tapered contour of the flights. The closure panels are selectively positionable to form an opening of a variable and predetermined size such that material deposited within the grinding chamber is retained therein and reduced in size until sufficiently small to pass through the opening.

6 Claims, 5 Drawing Sheets

DUAL AUGER SHREDDER

CROSS-REFERENCE TO RELATED APPLICATION

This application is a continuation-in-part of Koenig U.S. Pat. application Ser. No. 187,229 filed April 28, 1988.

BACKGROUND OF THE INVENTION

The present invention relates to devices for grinding and shredding large, rigid objects and, more particularly, to devices utilizing large screw augers for grinding and shredding such material.

Many devices are known which are capable of grinding, shredding and otherwise reducing the size of scrap material such as wooden pallets, wooden crates, fifty-five-gallon oil drums of waste material such as concrete, railroad ties, and the like. For example, Koenig U.S. Pat. No. 4,253,615 discloses a pallet auger which includes a grinding chamber within which is mounted a single screw having a tapered flight and which extends from a substantially vertical rear wall into a discharge conduit extending through the front wall of the grinding chamber. The screw flight includes teeth which project radially from the periphery of the flight and mesh with fixed breaker bars positioned on the side walls and floor of the grinding chamber, which together form a continuous, arcuate surface sloped to provide a close clearance with the tapered flight.

A different design is disclosed in Wexell, et al. U.S. Pat. No. 4,632,317. That device discloses a multiple screw grinding device having an open-bottomed grinding chamber and a plurality of auger screws, each having a non-tapered flight and being offset with respect to each other.

A disadvantage with both types of devices is that there is no mechanism for controlling the ultimate size of the material which is ground by the auger screws. With the Koenig device, some size control can be achieved by restricting the flow of ground material through the exit conduit of the grinding chamber. This "back pressure" allows the end of the screw flight, which includes a radially-extending edge, to perform a shredding action upon a plug of material retained within the exit opening. In contrast, the Wexell et al. device is designed to be a "single pass" device in which the ultimate size of material shredded is a function of the spacing between the slighted grinding screws which are positionable relative to each other.

Another disadvantage existing with the Wexell et al. device is that the non-tapered screw flights present a level and even surface to objects such as pallets and large crates so that the broad faces of those objects, when fed downwardly onto the screws, ride or bridge the screw flights. It is then necessary for an operator to manually press the material into the cutting edges of the screw flights, a labor-intensive and often dangerous procedure.

Accordingly, there is a need for a device which accepts and grinds large objects such as pallets, crates, oil drums and the like which has the capability of controlling the ultimate size of the pieces of the shredded material. There is also a need for a device for grinding and shredding large objects which is especially suited to accept objects having large surfaces and which prevents a bridging or riding upon the grinding elements.

SUMMARY OF THE INVENTION

The present invention is a shredding and grinding device having a pair of screw augers with parallel rotational axes within a grinding chamber and having flights which taper in reverse directions. The use of twin augers, as opposed to a single auger, provides a larger "live" grinding area for a grinding chamber of a given size. Furthermore, the reverse taper of the screws presents an uneven surface to material fed downwardly into the grinding chamber, thereby minimizing the likelihood that objects with large surfaces will bridge or ride upon the screw flights. Furthermore, the tapered flights expose more of the working surface of each turn of the screw flights so that the working surfaces can engage edges or corners of large-surfaced objects and compress them towards the center of the grinding chamber to be crushed and drawn downwardly between the screw augers.

The bottom of the grinding chamber includes a pair of closure doors which are displaceable relative to each other to form an opening of a variable and predetermined size below the auger screws. Material fed downwardly into the grinding chamber is retained within the chamber and reduced in size by the action of the auger screws until the resultant pieces are sufficiently small to pass through the opening. Accordingly, the dual auger shredder of the present invention is capable of performing selective size reduction of large objects.

In addition, the closure panels can be completely closed to seal the bottom of the grinding chamber. Consequently, material fed downwardly into the grinding chamber is retained in the grinding chamber and the screw augers perform a blending or homogenizing function, in addition to size reduction.

If different materials are fed into the grinding chamber in a single batch, they are broken up and their component pieces are homogenized or blended uniformly. Also in this mode, material which is broken up and falls between the flights of a screw is transported from the large diameter end of the screw along the screw shaft to the small diameter end where it builds up into a mass. That mass is engaged by the large diameter end of the adjacent screw and transported back to the opposite end of the grinding chamber. In doing so, the material is further reduced in size and compressed.

In a preferred embodiment, the screw flights include radially-projecting teeth which mesh with stationary breaker bars attached to the side walls and bottom of the grinding chamber. The meshing of the teeth and breaker bars acts to break up particles into smaller pieces as they are ground and transported by the screw flights.

Accordingly, it is an object of the present invention to provide a dual auger shredder which is capable of reducing large objects to pieces of a predetermined size and consistency; a dual auger shredder which is capable of accepting large-surfaced objects such as wood pallets, crates and oil drums, and engaging and grinding those objects without manual assistance; a dual auger shredder which is capable of performing a blending or homogenizing function; and a dual auger shredder which is rugged and operates at a low speed to minimize projection of materials upwardly from the grinding chamber.

Other objects and advantages of the present invention will be apparent from the following description, the accompanying drawings, and the appended claims.

DETAILED DESCRIPTION OF THE PREFERRED EMBODIMENT

Figure 1:
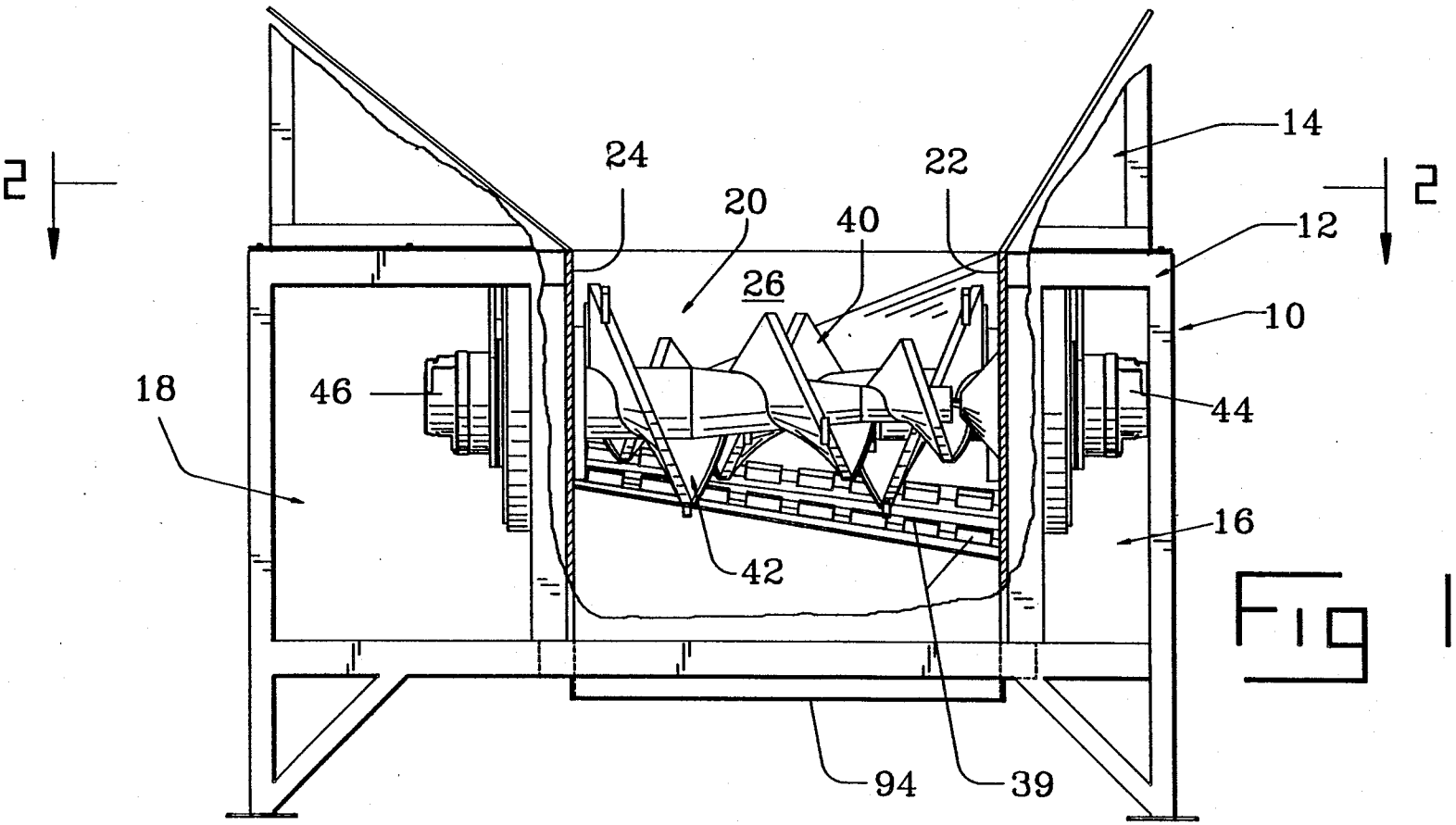
FIG. 1 is a somewhat schematic, side elevation of a preferred embodiment of the dual auger shredder of the present invention, in which the feed hopper and grinding chamber are partially broken away.
Figure 2:
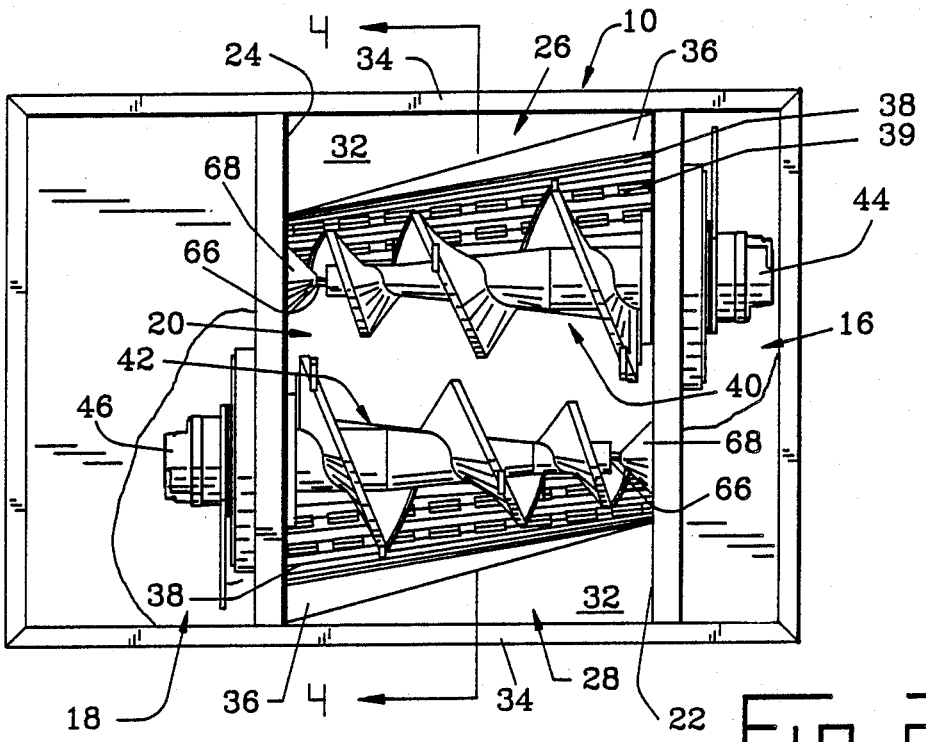
FIG. 2 is a plan view of the shredder taken at line 2—2 of FIG. 1 in which the motor housing top panels are partially broken away and the closure panels are in an open position.
Figure 3:
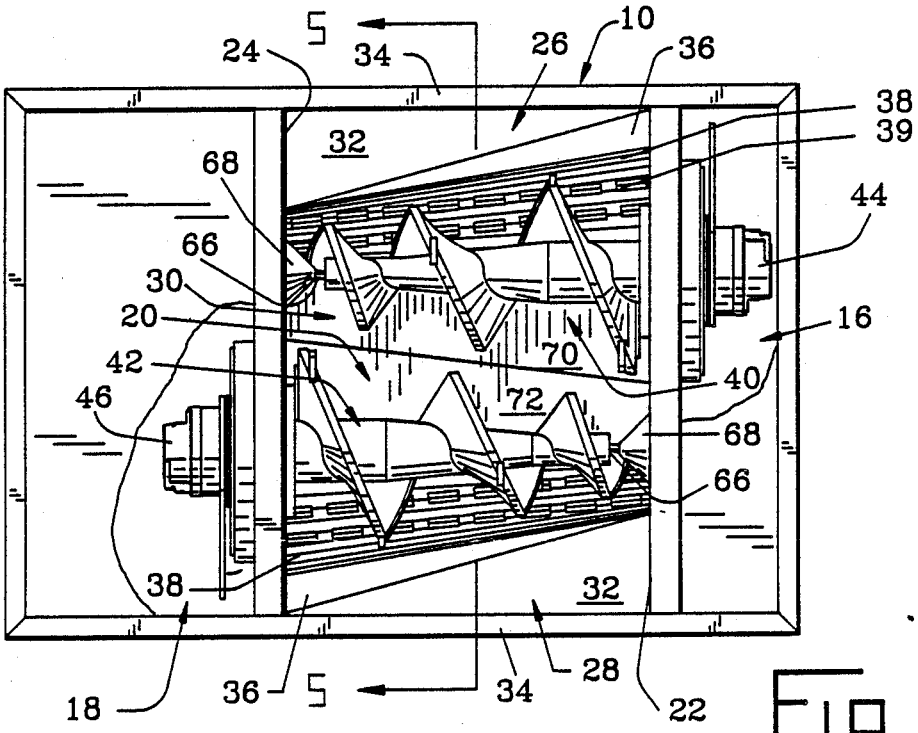
FIG. 3 is a plan view of the shredder of FIG. 2 in which the closure panels are in a closed position.

As shown in FIGS. 1, 2 and 3, the dual auger shredder of the present invention, generally designated 10, includes a frame 12 and hopper 14. Frame 12 is segmented into first and second motor housings 16, 18 and a grinding chamber 20.

Grinding chamber 20 is defined by substantially vertical front and rear walls, 22, 24, arcuate side walls 26, 28, and bottom 30. As best shown in FIGS. 2, 3, 7 and 8, the side walls 26, 28, each include angled surface 32, which is attached to the adjacent longitudinal strut 34 of frame 12 at its upper surface, a downwardly extending surface 36, and an arcuate surface 38. The arcuate surfaces 38 each include a plurality of breaker bars 39 spaced along its length.

As shown in FIGS. 1, 2 and 3, a pair of screw of augers, 40, 42, are mounted within the grinding chamber 20. Screw auger 40 is rotatably mounted on front wall 22 and is driven by hydraulic motor 44, and screw auger 42 is rotatably mounted on rear wall 24 and is driven by hydraulic motor 46. Hydraulic motors 44, 46, are powered by a high pressure hydraulic system (not shown) of conventional design. Hydraulic motors 44, 46, are positioned within first and second motor housings 16, 18, respectively, and are thereby shielded from the corrosive environment within which the shredder 10 may be placed. Motor housings 16, 18, also house a programmable control (not shown) which actuates the screws to rotate to draw material downwardly between them, or to reverse rotation if a jam or buildup occurs, or to rotate at different speeds. An example of such a mechanism is disclosed in Koenig U.S. Pat. No. 4,253,615, hereby incorporated by reference.

Figure 6:
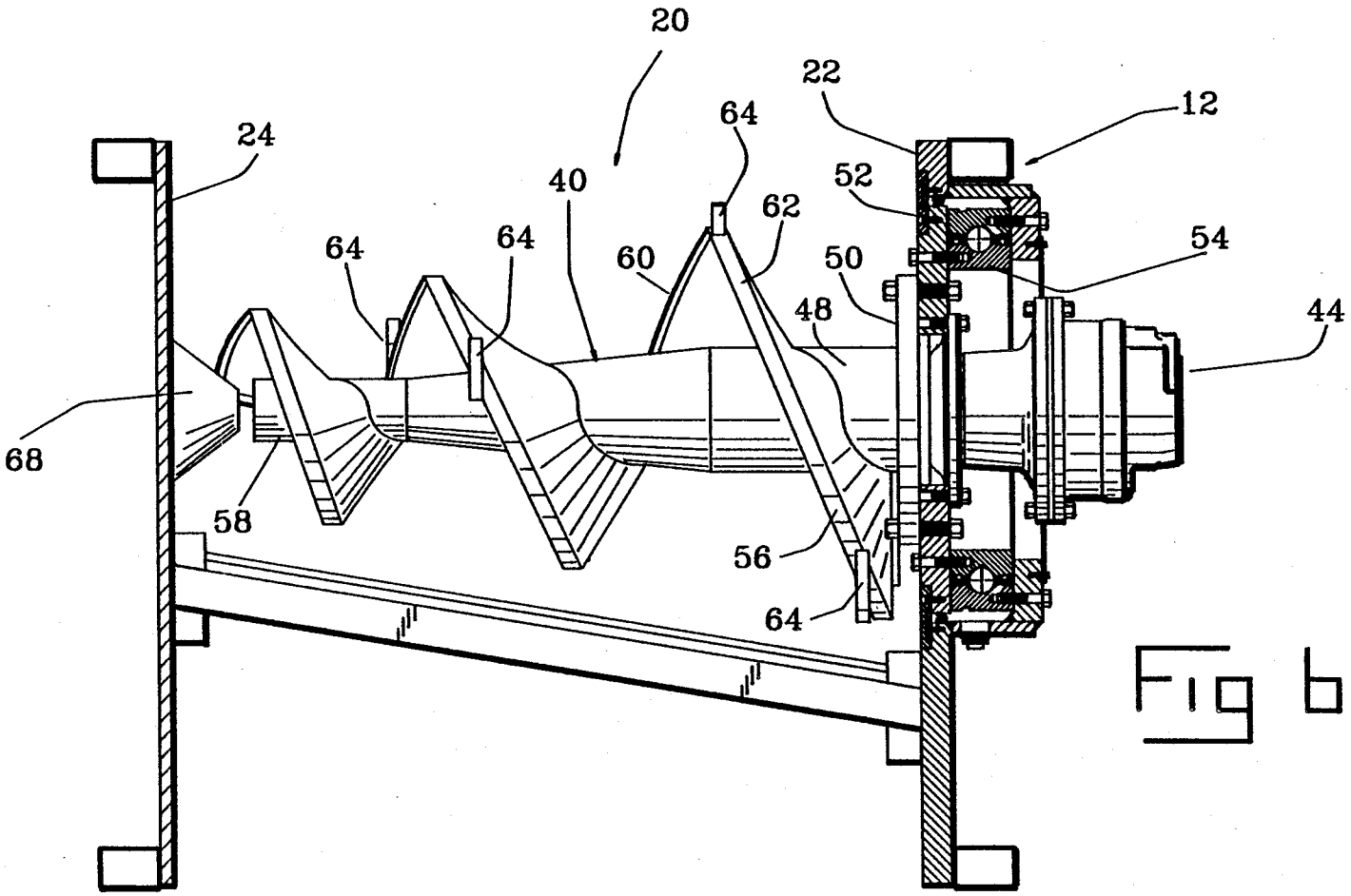
FIG. 6 is a detail side elevation in section of the shredder of FIG. 1, showing a screw auger within the grinding chamber.

As shown in FIG. 6 for screw auger 40, the screw augers 40, 42 each include a central shaft 48 which, in the preferred embodiment, tapers along its length and is mounted at its base on a disc-shaped base plate 50. Base plate 50 is bolted to a rotating ring 52, set into the front wall 22, and is supported by a bearing assembly, generally designated 54. The screw auger 40 includes a flight 56 which tapers in diameter and decreases in pitch from the base plate 50 to an outer segment 58. The flight 56 includes a hardened working edge 60 at its periphery which extends the length of the flight.

Figure 4:
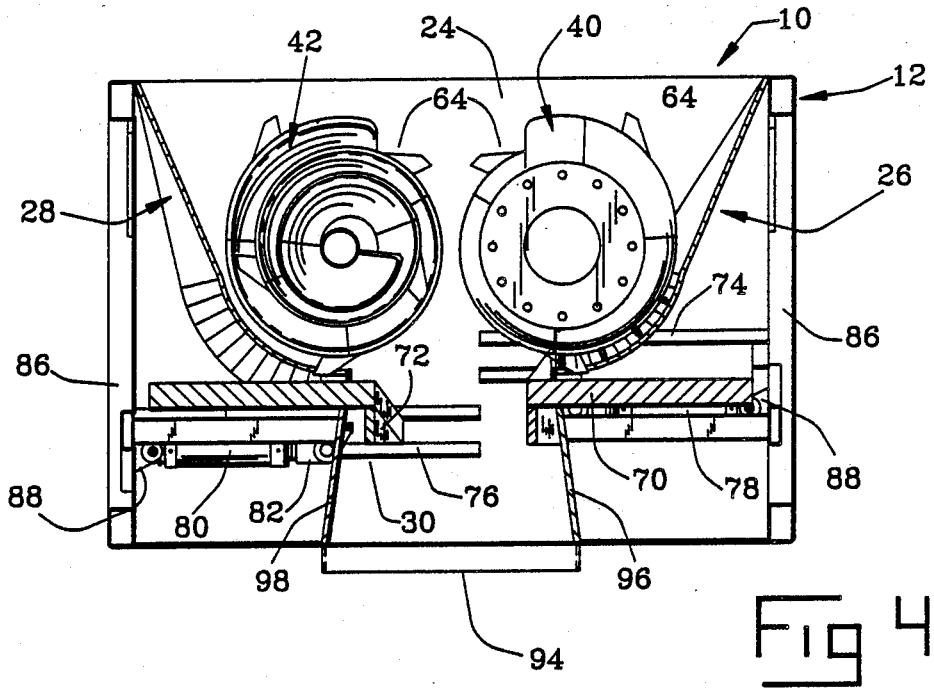
FIG. 4 is an end elevation in section of the auger shredder taken at line 4—4 of FIG. 2.
Figure 5:
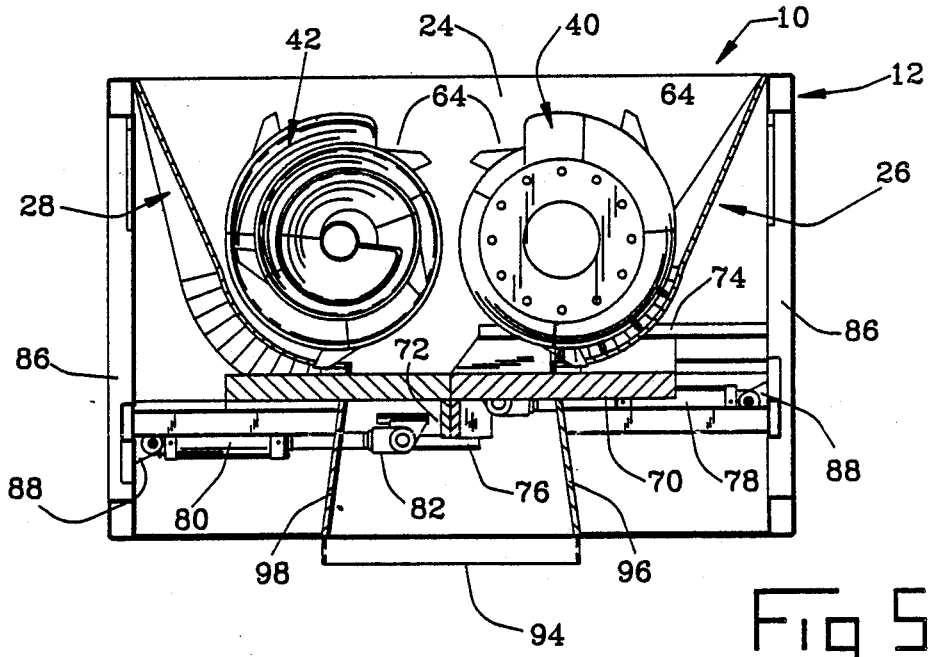
FIG. 5 is an end elevation in section of the shredder taken at line 5—5 of FIG. 3.

Spaced along the outer periphery 62 of the flight are a plurality of teeth 64 which, as shown in FIGS. 4 and 5, are wedge-shaped and extend radially from the outer peripheries 62 of the screw augers 40, 42. Teeth 64 and breaker bars 39 are spaced such that the teeth mesh with the breaker bars when the screw augers 40, 42 are rotated.

The screw augers 40, 42 are positioned within the grinding chamber 20 such that the flights 56 taper oppositely to each other, as shown in FIGS. 1, 2 and 3. This presents an uneven surface to an object which is dropped downwardly through hopper 14 onto the auger screws 40, 42, thereby reducing the likelihood that the object will ride upon or bridge the flights of the screws and not be engaged by the working edges 60 of the screw flights 56. Furthermore, the tapered shapes of the flights 56 expose more of the working edge 60 of the flights than would occur with a non-tapered flight. This greater exposure allows the working edge 60 to engage a corner or edge of a large-surfaced object such as a pallet or crate.

The screw augers 40, 42 are cantilevered from their respective walls 22, 24, but include tips 66, extending outwardly from the ends of the screws which engage cones 68. Cones 68 are attached to walls 22, 24 opposite the wall supporting the associated screw augers 40, 42, and help direct the flow of material within the grinding chamber 20 when the auger screws are rotated.

The bottom 30 of the grinding chamber includes a pair of closure doors 70, 72, which are plate-shaped and extend between front and rear walls 22, 24, as shown in FIG. 3. As shown in FIGS. 4 and 5, closure doors 70, 72 slide along upper and lower pairs of rails 74, 76 respectively (shown in FIGS. 4 and 5 for rear wall 24). The closure doors 70, 72 are slidably displaced along the rails 74, 76 by double acting cylinder motors 78, 80, which are attached to the doors by clevis assemblies 82 and to the side walls 84, 86 of the frame 12 by clevises 88.

Figure 7:
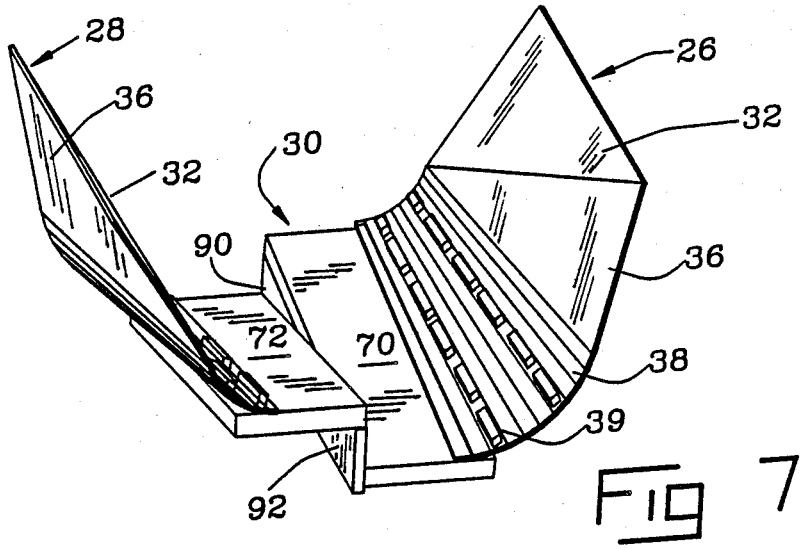
FIG. 7 is a detail perspective view of the side and bottom walls of the grinding chamber of the auger shredder of FIG. 1, in which the closure doors are closed.
Figure 8:
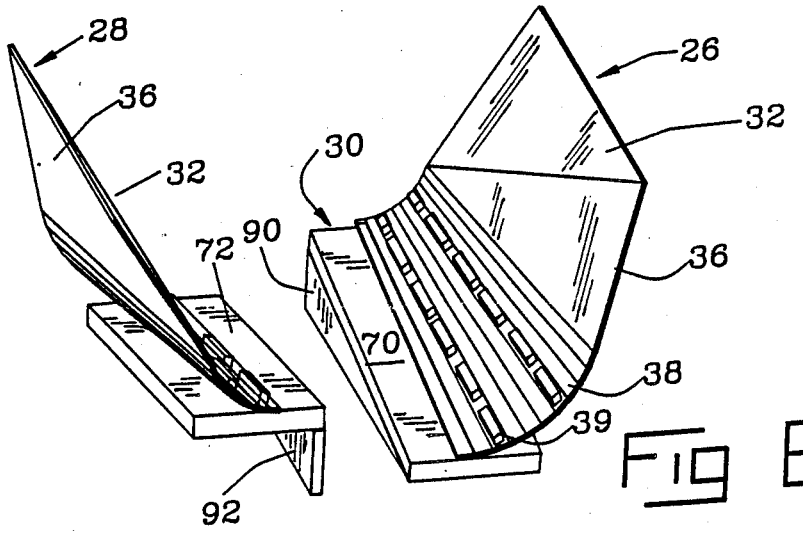
FIG. 8 is a perspective view of the detail of FIG. 7 in which the closure doors are in an open position.

As shown in FIGS. 7 and 8, the closure doors 70, 72 each include downwardly depending, wedges 90, 92. The wedges 90, 92 are positioned on the closure doors 70, 72 such that a complete seal is formed when the doors are closed, as shown in FIG. 7. The closure doors 70, 72 are skewed relative to each other so that they conform to the sloped contours of their associated side walls 26, 28. As a result, the side walls 26, 28 and bottom 30 of the grinding chamber 20 conform to the tapers of the flights 56 of the oppositely disposed screw augers 40, 42.

Positioned below the closure doors 70, 72 is a discharge chute, generally designated 94, which is defined by walls 96, 98 and portions of front and rear walls 22, 24. Walls 96, 98 have openings (not shown) through which the clevises 82 of the double acting cylinder motors 78, 80 extend when positioning the closure doors 70, 72.

The operation of the dual auger shredder 10 is as follows. The hydraulic motors 44, 46 are actuated to begin rotation of the screw augers 40, 42 at a relatively low speed, within a range of less than one revolution per minute to 30 revolutions per minute. The screws 40, 42 are counter-rotated so that the teeth 64 rotate toward the gap between the auger screws. As material is dropped through the hopper 14, it is engaged by the screw flights 56 of the screw augers 40, 42. The exposed working edges 60 of the screw flights engage the corners and edges of large-surfaced materials such as pallets, crates, fifty-five gallon oil drums, railroad ties, and the like, compressing the object towards the center of the grinding chamber 20.

At the same time, the teeth 64, which rotate in a circular orbit perpendicular to the axis of rotation of the screw augers 40, 42, tend to hold the object they engage stationary with respect to the longitudinal axes of the screw augers. However, the working edges 60 of the screw augers 40, 42 act to move that same piece so that the piece is broken up along its length in addition to being compressed and crushed. This is because the point of engagement of the working edge 60 with the object to be shredded progresses towards the center of the grinding chamber 20 as the screw auger 40, 42 rotates, while the path of the teeth 64 remains stationary relative to its position along the longitudinal axis of the screw auger. Consequently, material is compressed toward the center of the screw auger and broken up as it is compressed, so that it is more easily drawn downwardly between the two screw augers 40, 42.

If it is desired to shred and grind material until it has reached a predetermined width, the closure doors 70, 72 are opened to form a gap of a predetermined width such as that shown in FIGS. 4 and 8. Consequently, material within the grinding chamber 20 remains in the chamber and is continually ground and shredded by the interaction of the teeth 64, screw flights 56 and breaker bars until it has been reduced in size sufficiently to pass through the opening.

If it is desired to operate the dual auger shredder to perform a blending or homogenizing function, the closure door 70, 72 is completely closed as shown in FIGS. 5 and 7. Material fed into the grinding chamber 20 is retained in the chamber and is broken up until it is sufficiently small to fit between the turns of the flights 56 of the screw augers 40, 42. Material this size is pushed by the rotating flights 56 from the large diameter end of an auger screw to the small diameter end, where it builds up to form a plug. This plug is engaged by the large diameter end of the adjacent screw auger and is again transported by along that screw auger to its small diameter end. As it progresses along the length of the grinding chamber, it is further reduced by the meshing of the teeth 64 and breaker bars 39. At the same time it is reduced in size, it is also blended and homogenized. When this action is completed, the closure doors 70, 72 are opened to allow the material to exit through the discharge chute 94.

While the form of apparatus herein described constitutes a preferred embodiment of the invention, it is to be understood that the invention is not limited to this precise form of apparatus, and that changes may be made therein without departing from the scope of the invention.

What is claimed is:

1. A shredder for grinding large objects to form material of a smaller, predetermined size, comprising:

first and second taper flight screw augers positioned such that said flights taper oppositely relative to each other;

a housing defining a grinding chamber having side walls shaped to conform to said tapered flights of said augers;

means for rotating said screw augers;

said grinding chamber including first and second closure doors positioned below said augers and skewed relative to each other to conform to said tapered flights, said closure doors being positionable between a closed position, wherein said doors are in abutting relation to each other and form a seal sufficient to prevent comminuted material in said grinding chamber from flowing between said doors, and an open position, wherein said doors are spaced apart to form an opening therebetween, such that material in said grinding chamber reduced by said augers falls through said opening between said doors; and hopper means positioned above said grinding chamber for directing material downwardly into said grinding chamber to be shredded by said augers.

2. The shredder of claim 1 wherein said closure doors are slidably mounted on said housing; and further comprising means for displacing said closure doors toward and away from each other to vary size of said opening.

3. The shredder of claim 2 wherein said first and second closure doors each include downwardly depending means extending from abutting edges thereof for completely sealing said floor when said doors are closed.

4. The shredder of claim 3 wherein said closure doors extend an entire length of said grinding chamber.

5. The shredder of claim 4 wherein said grinding chamber includes front and rear walls, and said front and rear walls each include track means for receiving ends of said closure doors slidably therein.

6. A shredder for grinding objects to form material of a smaller, predetermined size, comprising:

a housing having substantially vertical front and rear walls, curved side walls and a floor defining a grinding chamber;

first and second tapered flight screw augers rotatably mounted within said chamber and oriented to rotate about axes extending between said front and rear walls and being positioned such that said flights taper oppositely relative to each other;

means for rotating said screw augers;

said floor including first and second closure doors extending between said front and rear walls and skewed relative to each other such that each of said closure doors follows a slope of one of said screw flights superposed thereto, said closure doors being positionable between a closed position, wherein said doors abut each other to prevent material from flowing from said grinding chamber, and an open position, wherein said doors separate to form an opening therebetween;

each of said closure doors including a downwardly depending component so that, when brought into said closed position, said closure doors completely close said floor;

said front and rear walls each including track means for guiding said closure doors; and double-acting cylinder motor means for displacing said closure doors toward and away from each other, whereby an opening of a predetermined size may be formed in said floor such that material fed into said grinding chamber is retained therein and reduced in size until sufficiently small to pass between said closure doors.

* * * * *